US005398746A

United States Patent [19]

Igarashi

[11] Patent Number: 5,398,746

[45] Date of Patent: Mar. 21, 1995

[54] GOLF CLUB HEAD WITH INTEGRALLY CAST SOLE PLATE AND FABRICATION METHOD FOR SAME

[76] Inventor: Lawrence Y. Igarashi, 30231 Tomas Rd., Rancho Santa Margarita, Calif. 92688

[21] Appl. No.: 156,613

[22] Filed: Nov. 23, 1993

[51] Int. Cl.[6] ..... B22D 19/00

[52] U.S. Cl. ..... 164/98; 164/108; 164/111; 164/132

[58] Field of Search ..... 164/98, 108, 111, 132

[56] References Cited

U.S. PATENT DOCUMENTS 5,219,408 6/1993 Sun ..... 164/76.1

*Primary Examiner*—Kuang Y. Lin

*Attorney, Agent, or Firm*—Roberts and Quiogue

[57] ABSTRACT

A metal wood golf club head with a hollow body shell of a first lightweight material and a sole plate of a second material having a higher specific weight density than the first material. The sole plate is attached to the shell without welding, fasteners or force-fitting. The center of gravity of the head is lowered, and other weight distributions can be achieved by alternate sole plate configurations, such as heel, toe or rear weighting. The head is fabricated by a process which includes the steps of providing the sole plate of the second material, disposing a core adjacent the interior surface of the sole plate, disposing an exterior mold about the core so that the exterior mold, the core and sole plate collectively define a mold cavity in the form of the body shell, filling the cavity with the second material in a fluid state, and permitting the second material to solidify. Upon solidification, the second material locks onto the sole plate, fixing the sole plate in position. The core may comprise a hollow metal structure, or cast sand or ceramic particles in an adhesive binder. The sand or ceramic core is later removed by heating the club head until the binder loses its effectiveness, and pouring the core particles out the hosel opening.

17 Claims, 4 Drawing Sheets

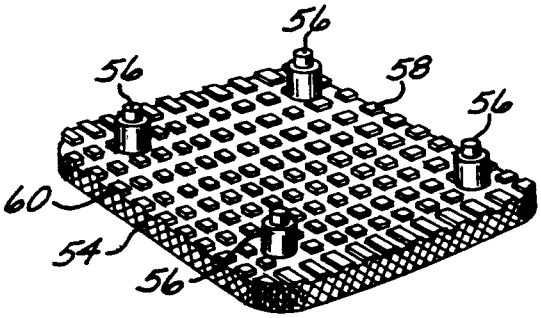
FIG. 8
FIG. 7
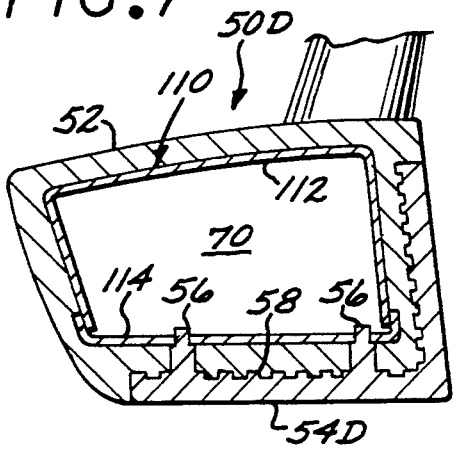
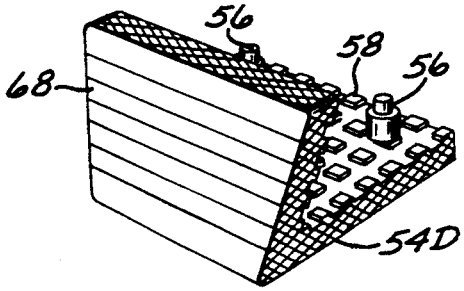
FIG. 9
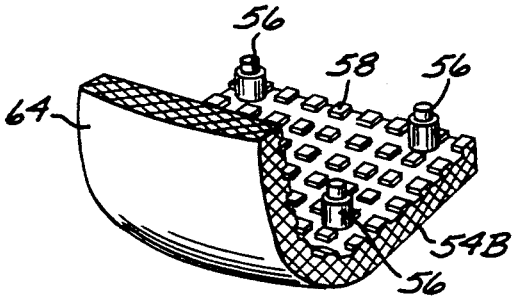
FIG. 10
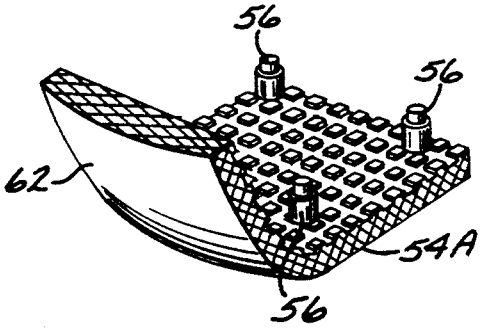
FIG. 11
FIG. 12
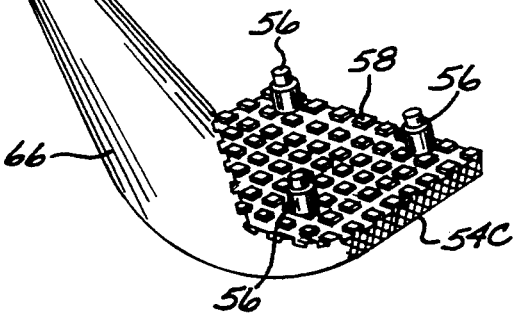

GOLF CLUB HEAD WITH INTEGRALLY CAST SOLE PLATE AND FABRICATION METHOD FOR SAME

BACKGROUND OF THE INVENTION

The present invention relates to golf clubs, and more particularly to a method for fabricating a metal club head having an integrally cast sole plate.

It is a benefit to provide a golf club "wood" head having a low center of gravity. This is particularly desirable for fairway woods, to ensure that the player hits "under" the ball for increased loft. Some natural wood clubs having a persimmon, maple, laminated wood or other wood body have been fabricated with a brass sole plate. The brass has a significantly higher specific weight density than persimmon wood, and so the center of gravity of the club head is lowered.

Efforts to lower the center of gravity of club heads will take into account restrictions on maximum weight of the club head to stay within standard swing weight ranges. This of course prevent the simple expedient of adding additional material to the sole plate to lower the center of gravity, since the weight limit would typically be exceeded.

The preferred material of "wood" clubs now in the world's golf market is a metal, typically fabricated in the form of a hollow metal club head. A typical material from which the head shell is fabricated is stainless steel. Investment casting techniques are in use to fabricate the hollow club heads. A typical technique involves the casting of the head body in two parts, and then welding the two parts together to form the complete head. This is expensive, time consuming, and requires additional finishing steps to smooth the weld bead.

U.S. Pat. No. 5,219,408 describes another process for casting a golf club head, wherein the head is cast as a single piece, and weights are later added in the sole portion. The addition of weights is an added process step.

SUMMARY OF THE INVENTION

The invention includes a method for fabricating a metal wood golf club head which solves the foregoing problems, and comprises a sequence of the following steps:

providing a sole plate member constructed of a first material having a relatively high specific weight density, the sole plate member having an exterior surface and an interior surface;

providing an interior mold core;

disposing the mold core in a predetermined position relative to the interior surface of the plate member;

disposing an external mold about the mold core so that the external mold, the mold core and the interior surface of the sole plate member define a cavity having an external periphery in the shape of a portion of the golf club head;

disposing a second material in a fluid state into the cavity, wherein the second material flows into contact with at least a portion of the sole plate interior surface, the second material having a lower specific weight density than the first material and permitting the second material to harden into a solid state, wherein the sole plate member becomes cast into place relative to said second material as a result of said hardening of the second material; and removing the external mold from the hardened second material and the sole plate member.

The invention further includes a metal wood golf club having a lowered center of gravity, comprising:

a sole plate member constructed of a first material having a relatively high first specific weight density, the sole plate member having an exterior surface and an interior surface;

a club head shell member defining a club head cavity, the shell member being fabricated of a light-weight second material, the second material having a said specific weight density lower than the first specific weight density;

wherein the sole plate member and the shell member are secured together in a unitary structure without the use of welding or fastener devices, and the club head has the characteristic of a low center of gravity.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 4–7 are cross-sectional views of alternate embodiments of golf club heads in accordance with the invention.

FIG. 8 is an isometric view of the sole plate of the club head of FIGS. 1–3, shown in isolation.

FIG. 9 is an isometric view of the sole plate of the club head of FIG. 7.

FIG. 10 is an isometric view of the sole plate of the club head of FIG. 5.

FIG. 11 is an isometric view of the sole plate of the club head of FIG. 4.

FIG. 12 is an isometric view of the sole plate of the club head of FIG. 6.

DETAILED DESCRIPTION OF THE PREFERRED EMBODIMENT

Figure 1:
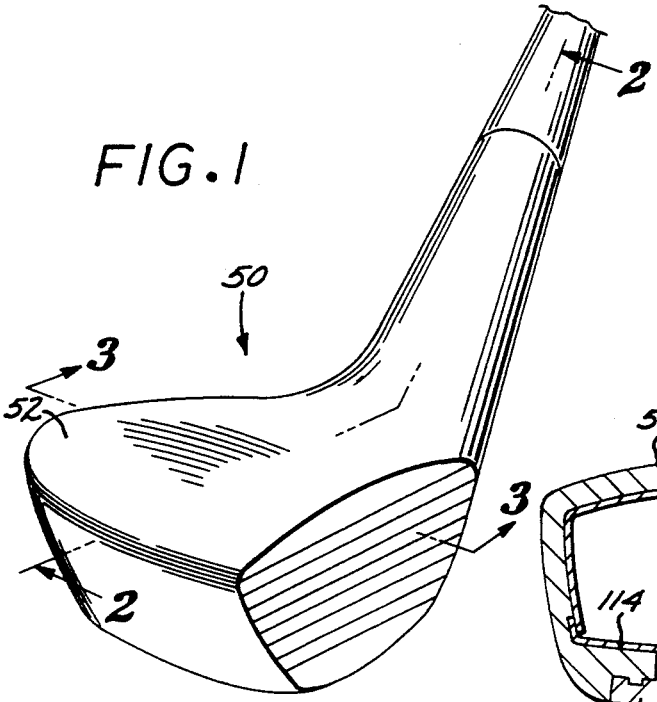
FIG. 1 illustrates in isometric view a metal golf wood club constructed in accordance with the invention.

FIG. 1 illustrates a metal wood golf club head 50 fabricated in accordance with this invention. The head 50 comprises a hollow shell body member 52 cast from a light-weight, high strength die-castable material such as aluminum or an aluminum alloy, and a sole plate element 54 which is secured without welding, screws or like fasteners or force-fitting to the shell body member. The sole plate 54 is fabricated from a relatively high specific weight material such as brass, stainless steel or zinc. The head 50 is hollow, and can be filled with a lightweight urethane foam or left as an empty shell. As a result of the differences in the specific weight densities of aluminum and brass, the center of gravity (CG) of the head 50 can be lowered from the CG position if the sole plate is fabricated of aluminum. The specific weight density of brass is in the range of 8.41 to 8.94 mg/m$^3$, while the specific weight density of aluminum is about 2.74 mg/m$^3$.

The sole plate 54 is shown in isolation in FIG. 8. The plate includes an interior surface 58, from which protrude a plurality of standoff elements 56, which are used to support a mold core 110, as more fully described below. The surface 58 is also roughened by many tabs 60, which can be regular or irregular in configuration. The side edges of the sole plate also have a roughened texture. The roughened texture of surfaces of the sole plate 54 helps to lock the sole plate to the shell member during the casting of the shell member, described more fully below.

Figure 4:
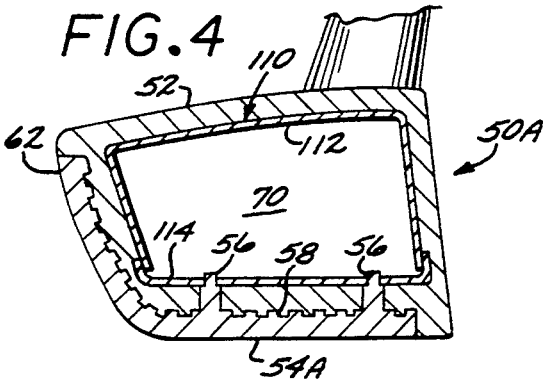
Figure 5:
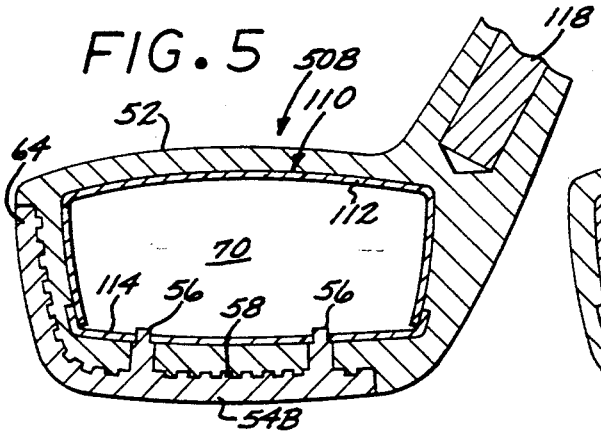
Figure 6:
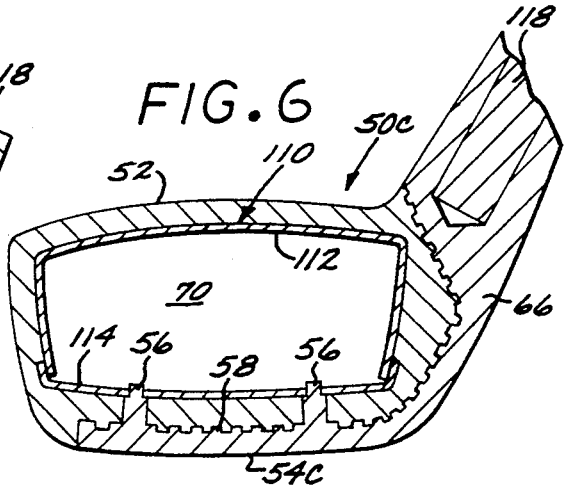

Other configurations of the sole plate can alternatively be employed. Alternative embodiments are shown in FIGS. 4–6 and 7–9. FIG. 4 shows aspects of a metal wood club head 50A wherein the sole plate member 54A is integrally formed with a rear wall area 62 which provides additional rear club weighting. FIG. 5 shows aspects of a metal wood club head 50B having a sole plate 54B, wherein the sole plate is integrally formed with a toe wall 64 which extends upwardly at the club toe region. The head 50B has toe weighting, provided by the increased weight of toe wall 64. FIG. 6 shows aspects of a metal wood club head 50C having a sole plate 54C, wherein the sole plate is integrally formed with a wall and hosel region 66 which accepts the club shaft. The head 50C has heel weighting, provided by the increased weight of the region 66. FIG. 7 shows aspects of a metal wood club head 50D having a sole plate 54D, wherein the sole plate is integrally formed with a front faceplate region 68. The head 50D has front weighting, provided by the increased weight of the region 68.

The sole plate 54 may be fabricated in any conventional manner, e.g. by die casting, machining, stamping, forging or the like.

Figure 2:
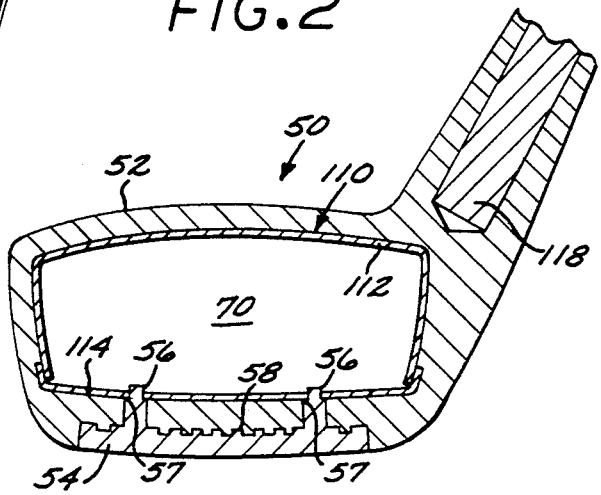
FIG. 2 is a cross-sectional view taken along line 2—2 of FIG. 1.
Figure 3:
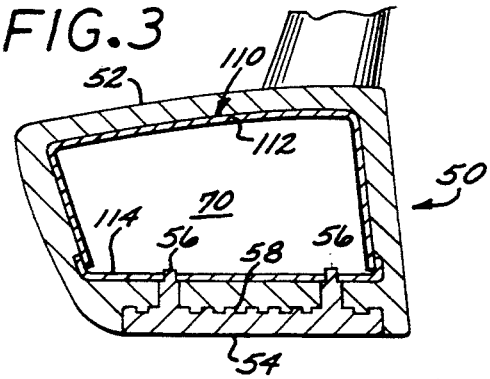
FIG. 3 is a cross-sectional view taken along line 3—3 of FIG. 1.
Figure 13:
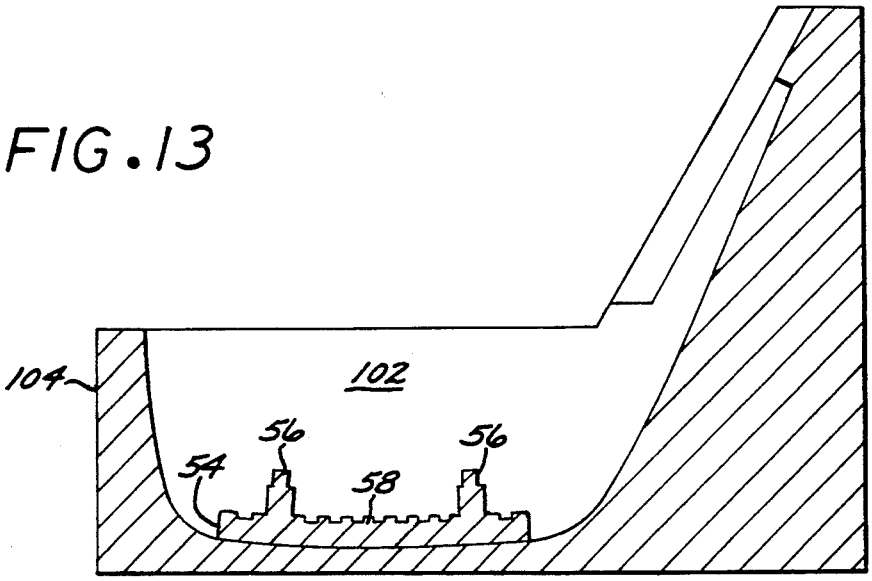
FIGS. 13–15 illustrate process steps of the preferred method of construction of a metal wood head in accordance with the invention.
Figure 14:
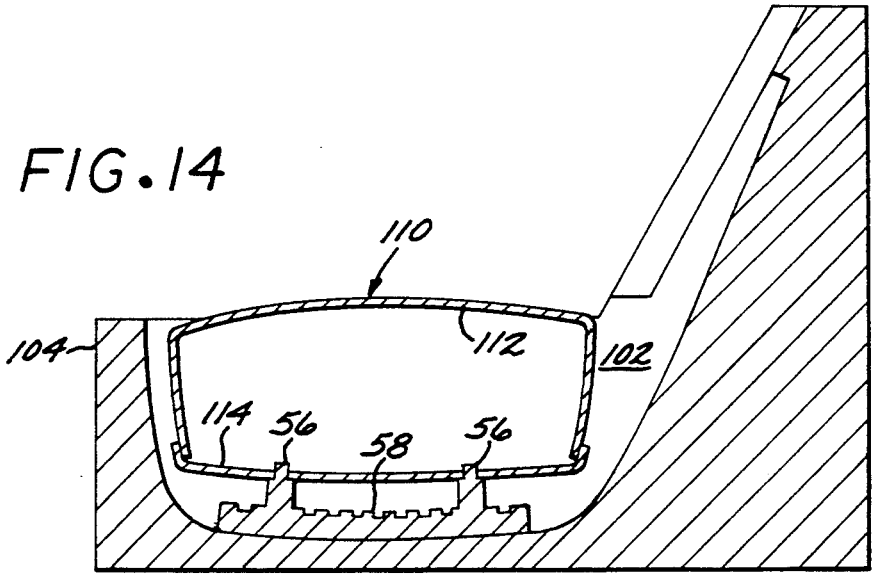
Figure 15:
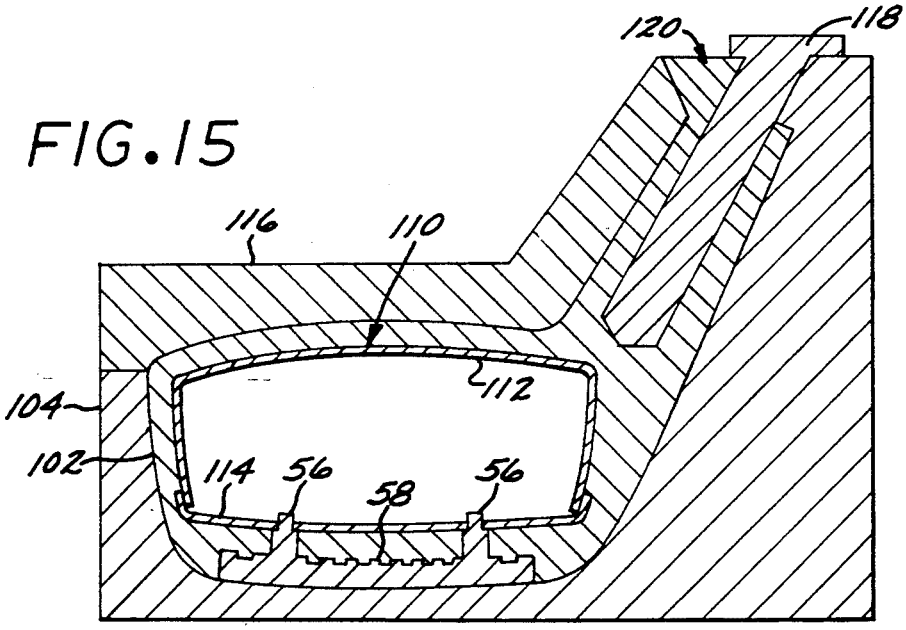

Referring now to FIGS. 13–15, a preferred method for fabrication of the golf club shown in FIGS. 1–3 is illustrated. In FIG. 13, the sole plate 54 is illustrated positioned in a cavity 102 defined by external lower mold half member 104. The plurality of standoff elements or pins 56 extend upwardly from the interior surface 58 of the sole plate. A mold core 110 is disposed in position on the standoff pins, as shown in FIG. 14. The core 110 in this exemplary embodiment comprises first and second thin sheet metal elements 112 and 114. The element 112 forms an inverted cup-like configuration, and the element 114 an essentially flat floor or cap, covering the open mouth of the cup. The edges of the element 114 are folded or crimped over the edges of the element 112 to form an essentially closed, hollow core element. The core 110 defines the hollow cavity 70 of the head 50. A plurality of holes are formed in the core element 114, in a pattern corresponding to the pattern of standoff pins 56. The core 110 is installed on the standoff pins so that the pins partially extend through the holes to support the core above the surface 58, and also register the position of the core in relation to the sole plate 54. The engagement of the pins 56 into the holes in element 114 also serves to resist lateral forces against the core during the casting process. The pins 56 are formed with shoulders 57, to register the vertical position of the core 110. The sheet metal element 114 rests on the shoulder 57. The pins 56 may be alternatively be tapered so that the sheet metal element 114 is situated above the surface 58, or the diameter of the holes and pins can be selected so that a modest force fit required to push the pins into the holes. The sheet metal enclosure formed by elements 112 and 114 is quite lightweight, with the sheet metal having an exemplary thickness in the range of 0.010 to 0.015 inches.

In the next step, shown in FIG. 15, an upper exterior mold element 116 is disposed in alignment with the lower mold element 104 to define a closed mold cavity, in cooperation with the inner mold core 110 and the sole plate 54. This closed mold cavity defines the body shell member 52, which is then formed by pouring molten aluminum or other lightweight material into the mold cavity via the top cavity opening 120 adjacent the hosel core pin 118. The molten aluminum fills the mold cavity, flowing about the core 110 and between the core element 114 and the surface 58 of the sole plate. The molten material fills the interstices between the texturing of the surface 58, locking the sole plate 54 to the shell 52. The molten aluminum cools into a solid state, thereby forming the shell element 52. After the aluminum has cooled, the external mold halves 104 and 116 are separated, and the metal wood club head 50 is then removed. The core 110 in this embodiment remains in place within the club head 50 after fabrication.

The melting temperatures of the materials used in the process of FIGS. 13–15 are compatible with the process. The melting temperature of aluminum is in the range of 1140 to 1192 degrees fahrenheit, that of brass is in the range of 1650 to 1890 degrees fahrenheit, and that of thin sheet steel is in the range of 2700 to 2800 degrees fahrenheit. Thus, the sole plate can itself be fabricated by a casting technique, and the sole plate thus produced can be used without deformation in the casting process of FIGS. 13–15 to partially form the mold cavity into which the molten aluminum is poured. Similarly, the sheet metal core will easily withstand the temperatures incurred during the aluminum casting process.

With the method of this invention, no welding, screws, fasteners or force-fitting are required to join two club head sections. A sole plate of a heavy metal such as brass is employed in combination with a shell body element of aluminum, aluminum alloys, or other lightweight high strength die-castable material. It is a feature of the invention that no welding, screws or other fasteners or force-fitting are required to join the sole plate to the shell body, since the sole plate is integrally molded with the shell body to form a unitary structure during fabrication. As a result, weight distribution can be improved by lowering the center of gravity, while at the same time fabrication expenses are reduced since no additional steps such as welding or attaching separate elements by fasteners are required.

Figure 16:
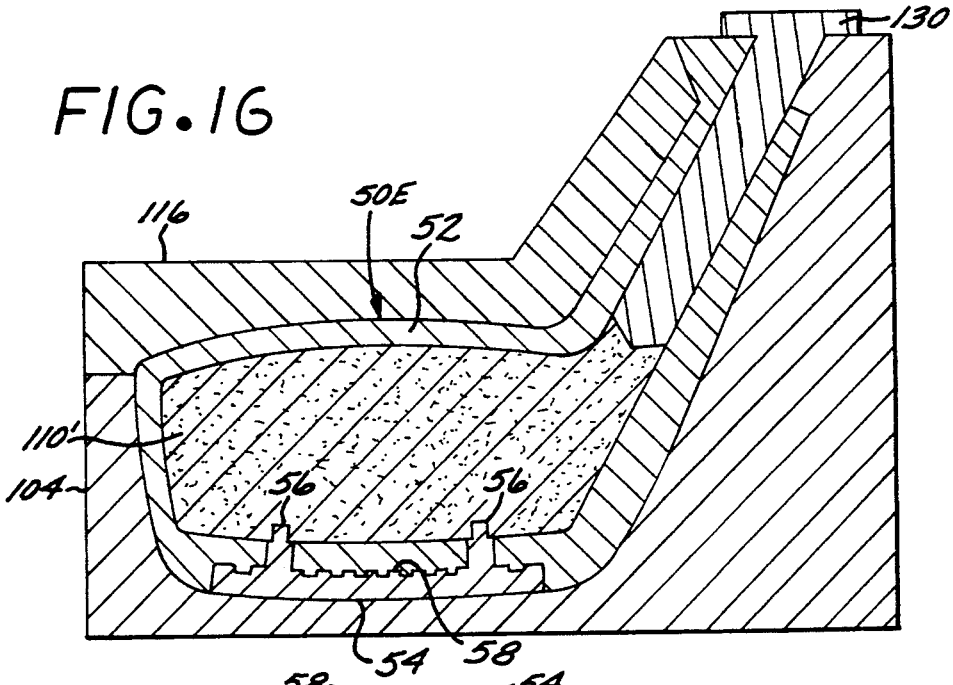
FIGS. 16–18 illustrate process steps of an alternate method of construction of a metal wood head in accordance with the invention.
Figure 17:
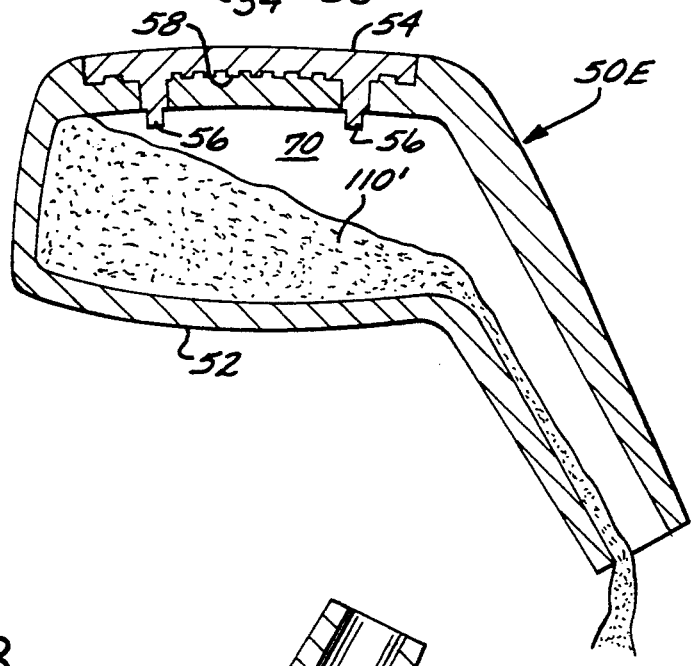
Figure 18:
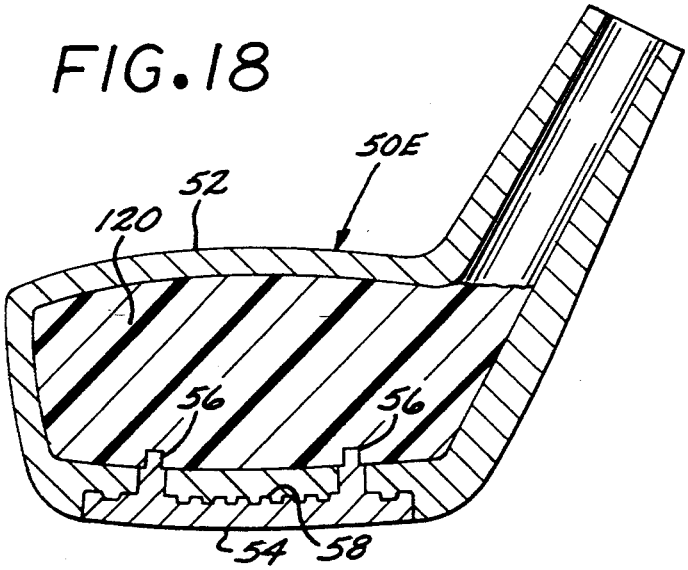

Referring now to FIGS. 16–18, an alternate fabrication technique is illustrated, wherein the core is fabricated of sand or ceramic particle mixture held together with an adhesive agent such as a phenolic resin. The sand or ceramic particle mixture core 110' essentially replaces the core 110 of FIGS. 13–15. The core 110' is formed in the desired shape of the hollow cavity 70'. Holes are formed in the bottom surface of the core 110' to receive the tips of the standoff pins 56. A hosel mold pin 130 defines the club hosel opening. After completion of the aluminum casting process, the club head is in the condition illustrated in FIG. 16, i.e. the shell body 52 has been formed and cooled. However, after the casting of the shell member is completed, the core 110' is removed in this embodiment in the following manner, as illustrated in FIG. 17. A characteristic of the adhesive agent is that it becomes ineffective as an adhesive agent upon being heated to a given temperature, in this case in the range of 475 to 600 degrees F., for a given bake time, at least three minutes for this exemplary adhesive agent. Since the melting temperature of aluminum is in the range of 1140 to 1292 degrees F., and that of brass is in the range of 1650 to 1890 degrees F., the constituent materials of the club head can readily withstand such heating to decompose the adhesive agent. Moreover, the heat to which the sand core is exposed during the aluminum casting process, while higher than the temperature needed to decompose the adhesive agent, is transitory, and does not occur for the necessary period of time. After the baking cycle, since the adhesive agent is no longer an effective binder, the sand or ceramic particle mixture can be poured or shaken out of the hosel opening after the hosel pin 130 has been withdrawn, as shown in FIG. 17. More active measures can also be taken to remove any sand or ceramic particles, e.g. applying compressed air or liquid under pressure into the cavity. The cavity 70' remains, and can be filled with lightweight urethane foam 120, or can be left as an empty cavity. The club shaft end can then be inserted into the hosel opening.

It is understood that the above-described embodiments are merely illustrative of the possible specific embodiments which may represent principles of the present invention. Other arrangements may readily be devised in accordance with these principles by those skilled in the art without departing from the scope and spirit of the invention. For example, while the method of fabrication has been described in the context of die-casting, the method can also be useful with investment casting club fabrication processes. In this alternate process, requiring more steps than the die-casting process, a wax mold is formed about the interior core 110 or 110', with the sole plate 54 in place adjacent the interior core. The wax mold defines the volume to be filled with the molten material such as aluminum to form the shell body member 52. Subsequently, a non-permanent, non-reusable exterior mold is formed over the exterior of the wax mold, e.g. by building up layers of ceramic mixtures. Once the exterior mold has been formed, the entire assembly is heated to liquify the wax mold, and the wax is poured out through the hosel opening. The hosel core pin is then inserted into the hosel opening, and the shell body material in a fluid state is poured into the volume formerly occupied by the wax mold. Upon cooling of the shell body material, the exterior mold is broken away, leaving the completed club head body.

What is claimed is:

1. A method for fabricating a metal wood golf club head, comprising a sequence of the following steps:

providing a sole plate member constructed of a first material having a relatively high specific weight density, said sole plate member having an exterior surface and an interior surface;

providing an interior mold core;

disposing said mold core in a predetermined position relative to said interior surface of said plate member;

disposing an external mold about said mold core so that said external mold, said mold core and said interior surface of said sole plate member define a cavity having an external periphery in the shape of a portion of said golf club head;

disposing a second material in a fluid state into said cavity, wherein said second material flows into contact with at least a portion of said sole plate interior surface, said second material having a lower specific weight density than said first material and permitting said second material to harden into a solid state, wherein said sole plate member becomes cast into place relative to said second material as a result of said hardening of said second material; and removing said external mold from said hardened second material and said sole plate member, whereby said second material forms a club head shell body member, and a unitary club head structure comprising said sole plate and said shell is formed without requiring welding, screws, or force-fitting to secure said sole plate in place.

2. The method of claim 1 wherein said sole plate member comprises at least one standoff member extending inwardly from said interior surface, said interior mold core being disposed in contact with said standoff member so that said cavity extends between said interior mold core and said interior surface of said sole plate member.

3. The method of claim 2 wherein said interior mold core comprises at least one opening defined therein to receive portions of said standoff members therein, thereby registering the position of said mold core in relation to said sole plate.

4. The method of claim 1 wherein said interior surface of said sole plate member is textured so as to provide interstitial crevices which become filled with said second material during said fabrication method.

5. The method of claim 1 wherein said first material comprises brass.

6. The method of claim 1 wherein said second material comprises aluminum, and said aluminum is disposed into said mold cavity while in a molten state.

7. The method of claim 1 wherein said interior mold core comprises a lightweight cavity-defining structure defined by thin sheet metal walls.

8. The method of claim 1 wherein said cavity-defining structure comprises an inverted cup-like first sheet metal member and a second sheet metal member covering an open cavity defined by said first sheet metal member, said second sheet metal member disposed adjacent said interior surface of said sole plate.

9. The method of claim 8 wherein said sole plate member comprises a plurality of standoff members extending inwardly from said interior surface in a predetermined spacing pattern, and said second sheet metal member has a plurality of holes formed therein in correspondence with said spacing pattern to receive therein portions of said standoff members, said standoff members serving to register the relative position of said core and said sole plate member.

10. The method of claim 1 wherein said interior core mold comprises a formed block of small particles held into a mold shape by an adhesive binder agent, and further comprising the step of removing said interior core mold by processing said fabricated golf club head to change adhesive properties of said adhesive agent such that said small particles are no longer held in said mold shape, and removing said small particles through an opening formed in said shell member.

11. The method of claim 10 wherein said small particles comprise sand.

12. The method of claim 10 wherein said small particles comprise ceramic particulate.

13. The method of claim 10 wherein said adhesive agent loses its effectiveness as an adhesive after being heated for a given period of time at or above a particular temperature, and said step of processing said fabricated golf club comprises heating said fabricated golf club at or above said predetermined temperature for at least said given period of time.

14. The method of claim 1 wherein said sole plate includes mass disposed at a heel region to provide heel weighting of a finished club head.

15. The method of claim 1 wherein said sole plate includes a volume of mass disposed at a toe region to provide toe weighting of a finished club head.

16. The method of claim 1 wherein said sole plate includes a volume of mass disposed at a face region to provide face weighting of a finished club head.

17. The method of claim 1 wherein said sole plate includes a volume of mass disposed at a rear region to provide rear weighting of a finished club head.

* * * * *